US007106288B2

(12) United States Patent
Shen et al.

(10) Patent No.: US 7,106,288 B2
(45) Date of Patent: Sep. 12, 2006

(54) SYSTEM FOR INCREASING LCD RESPONSE TIME

(75) Inventors: Yuh-Ren Shen, Tainan (TW); Ming-Jiun Liaw, Hsinchu (TW); Cheng-Chih Hsu, Ilan (TW)

(73) Assignee: Industrial Technology Research, Hsinchu (TW)

( * ) Notice: Subject to any disclaimer, the term of this patent is extended or adjusted under 35 U.S.C. 154(b) by 467 days.

(21) Appl. No.: 10/372,796

(22) Filed: Feb. 26, 2003

(65) Prior Publication Data

US 2003/0218591 A1 Nov. 27, 2003

(30) Foreign Application Priority Data

Feb. 27, 2002 (TW) ..... 91103511 A

(51) Int. Cl.
*G09G 3/36* (2006.01)

(52) U.S. Cl. ..... 345/89

(58) Field of Classification Search ..... 345/89, 345/690, 87, 98; 348/254, 674
See application file for complete search history.

(56) References Cited

U.S. PATENT DOCUMENTS

| | | | | |
|---|---|---|---|---|
| 5,764,216 | A * | 6/1998 | Tanaka et al. | 345/87 |
| 6,424,331 | B1 * | 7/2002 | Ozawa | 345/98 |
| 2002/0126075 | A1 * | 9/2002 | Willis | 345/87 |

* cited by examiner

*Primary Examiner*—Richard Hjerpe
*Assistant Examiner*—Kevin M. Nguyen
(74) *Attorney, Agent, or Firm*—Birch, Stewart, Kolasch & Birch, LLP

(57) ABSTRACT

A LCD driving system for increasing LCD response times. Voltages across liquid crystals are increased by modulating gamma reference voltages fed to a data driver, modulating image codes fed to the data driver, or both. Particularly, around the highest and the lowest image code, modulation of gamma reference voltages fed to a data driver is most effective.

14 Claims, 2 Drawing Sheets

SYSTEM FOR INCREASING LCD RESPONSE TIME

This nonprovisional application claims priority under 35 U.S.C. §119(a) on Patent Application Ser. No. 91103511 filed in TAIWAN on Feb. 27, 2002, which is herein incorporated by reference.

BACKGROUND OF THE INVENTION

1. Field of the Invention

The present invention relates to a system for driving a liquid crystal display, and particularly to a system for increasing LCD response time.

2. Description of the Related Art

The slow electro-optical LCD response time panels has been a major roadblock for the LCD market to expand beyond notebook and computer monitors. Although there has been significant progress in enhancing the switching speed of nematic liquid crystals (LCs), visual artifacts resulting from slow response are still quite noticeable. The full on/off time may be adequate, but response time between intermediate grays is inherently slow; up to 10 times as slow as the full on/off time.

Synthesizing even faster LC molecules is one obvious solution, however, expense and time are both considerable, since the speed must increase by as much as three times, There is a need for a method utilizing large voltage to drive liquid crystals to reduce response time.

FIG. 1 shows a conventional driving method of increasing LCD response time. The method utilizes the concept of data-overwrite realized by applying large voltage across liquid crystals to reduce response time. As shown in FIG. 1, a data driver pulls the voltage level $C_{n-1}$ of the n−1 frame to the voltage level $C_n$, wherein $C_{n-1}$, $C_n$, and $C_n'$ all represent voltages corresponding to specific gray levels. For a data driver not applied in data-overdriven method, a voltage level is $C_n$ and the trace T1 shows a charging process of liquid crystals. For a data driver applied in data-overdriven method, a voltage level is $C_n'$ higher than voltage level $C_n$ and the trace T2 shows a charging process of liquid crystals. When liquid crystals are charged to the voltage level $C_n$, the data driver drives the voltage level $C_n'$ to the voltage level $C_n$.

Because conventional data-overdrive mode is realized by switching image codes thereby changing voltage levels, there are limits to the highest and lowest image codes. There is thus a need for a novel method to realize data-overdriven.

SUMMARY OF THE INVENTION

It is therefore an object of the present invention to reduce LCD response times in LCD panel.

To achieve the above objects, the present invention provides a driving system for a LCD panel.

The driving system in the present invention includes a buffer, storage, a controller, a comparator, a programmable gamma reference voltage generator, and a data driver.

In order to shorten LCD response times, voltages across liquid crystals are increased by modulating gamma reference voltages fed to a data driver, modulating image codes fed to the data driver, or both.

At the highest or the lowest image code, reduced LCD response time is achieved by modulating gamma reference voltages fed to a data driver.

Around the highest or the lowest image code, LCD response times is achieved by modulating gamma reference voltages fed to a data driver is more effective.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the following detailed description and the accompanying drawings, which are given by way of illustration only, and thus are not limitative of the present invention, and wherein.

DETAILED DESCRIPTION OF THE INVENTION

There are three methods of increasing LCD response time: switching driving voltage, switching image code, or switching both driving voltage and image code.

Figure 1:
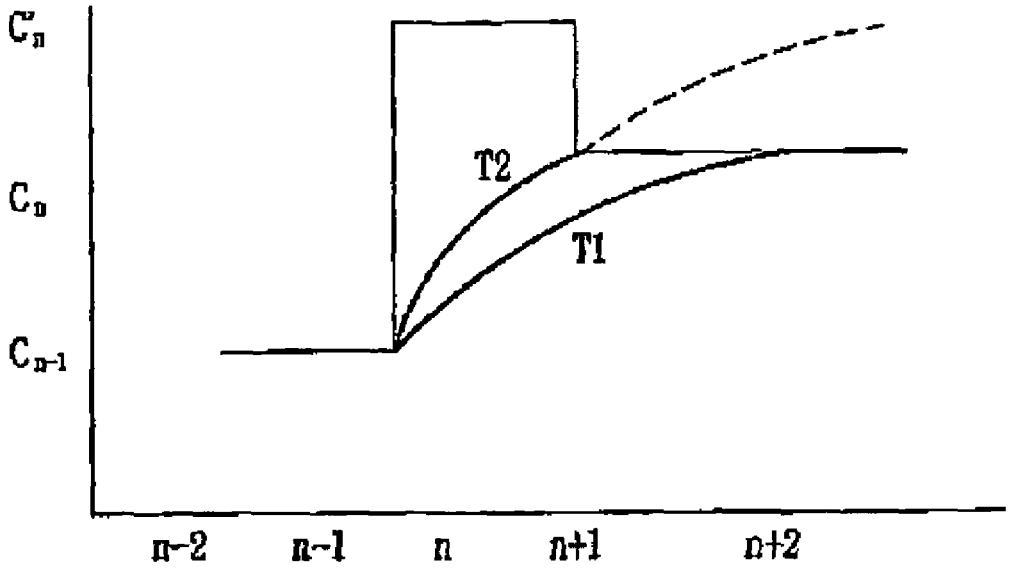
FIG. 1 (PRIOR ART)
FIG. 1 shows a conventional driving method of increasing LCD response times.
Figure 2:
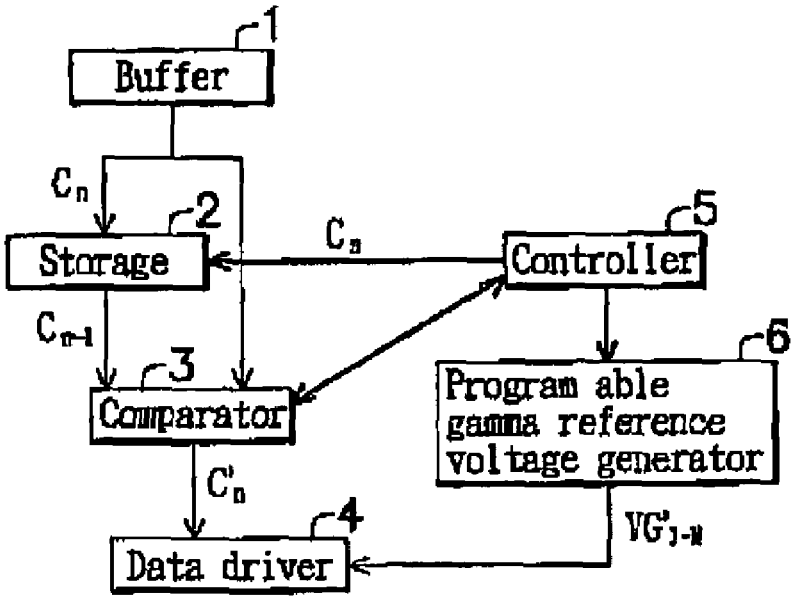
FIG. 2 is a block diagram of the present invention.

FIG. 2 is a block diagram of the present invention. A buffer 1 sends image code $C_n$ to storage 2 and a modulator 3. The storage 2 stores image code $C_n$ and outputs image code $C_{n-1}$ of the previous frame to comparator 3. A controller 5 sends control instructions to the comparator 3 and a programmable gamma reference voltage generator 6 for selecting driving method, either one or both. The comparator 3 receives image code $C_{n-1}$ of the previous frame from the storage 2 and image code C, from the buffer 1, compares image code $C_{n-1}$, $C_n$, and sends comparison results to the controller 5. The controller 5 sends modulation instruction to the comparator 3 according to comparison results. The comparator 3 outputs modulated image code $C_n'$, to a data driver 4. The controller 5 sends control instruction to the programmable gamma reference voltage generator 6, which generates gamma reference voltages $VG_1$~$VG_M$ to the data driver 4. The controller 5 also sends control instruction to the storage 2 for controlling access. The data driver 4 receives image codes $C_n'$ from the comparator 3 and gamma reference voltages $VG_1$~$VG_M$ to output driving voltage increasing response time.

Figure 3:
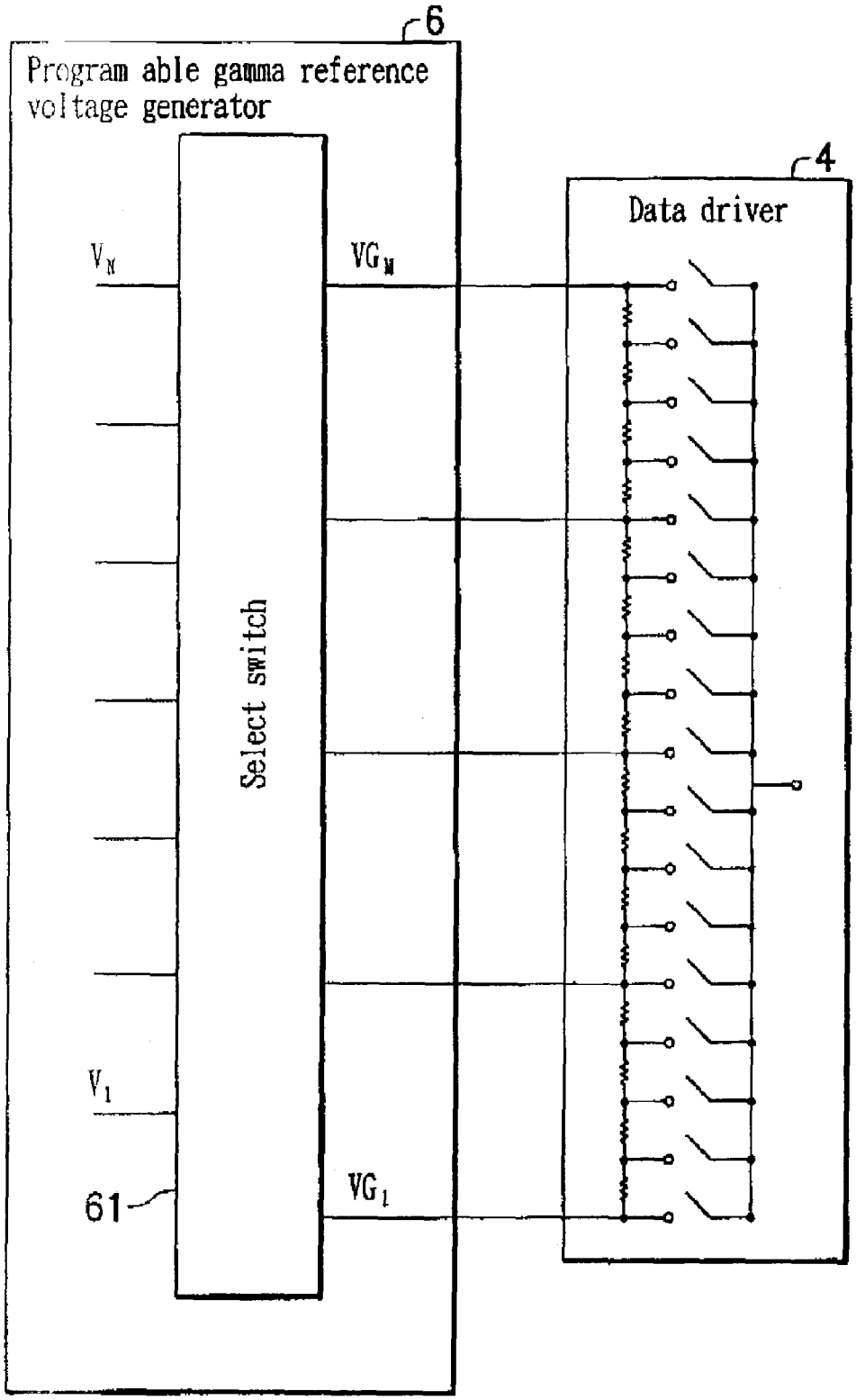
FIG. 3 is a block diagram of the data driver in the present invention.

FIG. 3 is a block diagram of the data driver in the present invention. A gamma correction curve is realized by M adjustable gamma reference voltages $VG_1$~$VG_M$ and select switch 61. The select switch 61 is used to adjust gamma reference voltages $VG_1$~$VG_M$. The relationships between gamma reference voltages $VG_1$~$VG_M$ and image codes are arranged as follows. The data driver 4 receives N bits, therefore, $2^N$ image codes and M gamma reference voltages $VG_1$~$VG_M$.

image code 0 to the 1st gamma reference voltage $VG_1$ image code 1 to the 2nd gamma reference voltage $VG_2$ image code $2^N$−2 to the M−1th gamma reference voltage $VG_{M-1}$ image code $2^N-1$ to the Mth gamma reference voltage $VG_M$ other image codes are arranged by LCD characteristics.

In order to eliminate limits of switching image codes at the first image code and the Mth image code, the present invention takes advantage of switching the 1st gamma reference voltage $VG_1$ and the Mth gamma reference voltage $VG_M$. At the image code $2^N-1$, the M gamma reference voltage $VG_M$ is adjustable for data overdrive and increasing response time, At the image code 0, the 1st gamma reference voltage $VG_1$ is adjustable for data overdrive.

In normal, not data-overdrive mode, there are relationships between gamma reference voltages and voltages of common electrode in LCD panel as follows.

When the LCD panel is normal white, then $$|VG_M-V_{COM}|<|VG_1-V_{COM}|.$$

When the LCD panel is normal black, then $$|VG_M-V_{COM}|>|VG_1-V_{COM}|.$$

In fast mode, when the image code of the previous frame is $2^N-2$ and the image code of the following frame is $2^N-1$, the relationships between gamma reference voltages and voltages of common electrode in LCD panel are as follows.

(1) When the driving voltage is not equal to a voltage corresponding to the image code $2^N-1$ and the LCD panel is normal white, then $|VG_M'-V_{COM}|<|VG_M-V_{COM}|$.

When the driving voltage is not equal to a voltage corresponding to the image code $2^N-1$ and the LCD panel is normal black, then $|VG_M'-V_{COM}|>|VG_M-V_{COM}|$.

(2) When the driving voltage is equal to a voltage corresponding to the image code $2^N-1$ and the LCD panel is normal white or black, then $|VG_M'-V_{COM}|\equiv|VG_M-V_{COM}|$.

When image codes are around $2^N-1$, driving voltage in fast mode is represented as follows.

$$V_1'=V_1-[c_{M-1}(D_i')-c_{M-i}(D_i)]\cdot VG_{M-1}+c_{M-1}(D_i')\cdot VG_M'-c_{M-1}(D_i)\cdot VG_M$$

wherein $$V_1=VG_{M-1}+c_{M-1}(D_1)\cdot(VG_M-VG_{M-1})$$

$V_1$ is a driving voltage of the previous frame $$V_1'=VG_{M-1}+c_{M-1}(D_1')\cdot(VG_M'-VG_{M-1})$$

$V_1'$ is a driving voltage of the following frame $c_{M-1}(D_1')$ is a image code of the following frame $c_{M-1}(D_1)$ is a image code of the previous frame When image code is $2^N-1$, the highest code, data-overdrive mode is only realized by switching gamma reference voltage as follows.

$$V_1'=V_1+c_{M-1}(D_1)\cdot(VG_M'-VG_{M-1})$$

In fast mode, when the image code of the previous frame is 1 and the image code of the following frame is 0, the relationships between gamma reference voltages and voltages of common electrode in LCD panel as follows.

(1) When the driving voltage is not equal to a voltage corresponding to the image code 0 and the LCD panel is normal white, then $|VG_1'-V_{COM}|<|VG_1-V_{COM}|$.

When tie driving voltage is not equal to a voltage corresponding to the image code 0 and the LCD panel is normal black, then $|VG_1'-V_{COM}|>|VG_1-V_{COM}|$.

(2) When the driving voltage is equal to a voltage corresponding to the image code 0 and the LCD panel is normal white or black, then $|VG_1'-V_{COM}|\equiv|VG_1-V_{COM}|$.

When image codes are around 0, driving voltage in fast mode is represented as follows.

$$V_i'=V_i-[c_0(D_1')-c_0(D_1)]\cdot VG_2+c_0(D_i')\cdot VG_1'-c_0(D_1)\cdot VG_1$$

wherein $$V_1=VG_1=c_0(D_1)\cdot(VG_2-VG_1)$$

$V_1'$ is a driving voltage of the previous frame $$V_1=VG_1+c_0(D_1')\cdot(VG-VG_1')$$

$V_1'$ is a driving voltage of the following frame $c_0(D_1')$ is a image code of the following frame $c_0(D_1)$ is a image code of the previous frame When image code is 0, the lowest code, data-overdrive mode is only realized by switching gamma reference voltage as follows.

$$V_1'=V_1+c_0(D_1)\cdot(VG_1'-VG_1)$$

The driving method is particularly effective at the highest and lowest image codes by switching the gamma reference voltage $VG_1$ and $VG_M$. The driving method applied to image codes around the highest and lowest is realized by switching image codes, gamma reference voltages, or both.

Although the present invention has been described in its preferred embodiments, it is not intended to limit the invention to the precise embodiments disclosed herein. Those who are skilled in this technology can still make various alterations and modifications without departing from the scope and spirit of this invention. Therefore, the scope of the present invention shall be defined and protected by the following claims and their equivalents.

What is claimed is:

1. A system for driving a LCD panel comprising:

a buffer for sending image codes;

a storage for storing the image codes;

a gamma reference voltage generator for generating gamma reference voltages;

a data driver for receiving the image codes and the gamma reference voltages to output driving voltages;

a comparator for comparing the image codes to send to the data driver; and a controller for generating controlling signal to control the storage, the comparator, and the gamma reference voltage generator, wherein the data driver has an arrangement of the image codes and the gamma reference voltages as follows;

the lowest image code corresponding to the lowest gamma reference voltage;

the second lowest image code corresponding to the second lowest gamma reference voltage;

the second highest image code corresponding to the second highest gamma reference voltage;

the highest image code corresponding to the highest gamma reference voltage; and the other image codes arranged by LCD panel characteristics; and when the data driver receives a second highest image code in the previous frame and a highest image code in the following frame, in fast mode, the gamma reference voltage generator acts as follows:

when the driving voltage is not equal to a voltage corresponding to the highest image code, a difference between a voltage of a common electrode in the LCD panel and the highest gamma reference voltage in fast mode is less than a difference between the voltage of the common electrode in the LCD panel and the highest gamma reference voltage; and when the driving voltage is equal to the voltage corresponding to the highest image code, the difference between the voltage of the common electrode in the LCD panel and the highest gamma reference voltage in fast mode is less than the difference between the voltage of the common electrode in the LCD panel and the highest gamma reference voltage.

2. The system for driving the LCD panel as claimed in claim 1 wherein the LCD panel is normal white.

3. The system for driving the LCD panel as claimed in claim 1 wherein the LCD panel is normal black.

4. The system for driving the LCD panel as claimed in claim 1 wherein when the data driver receives image code around the lowest, in fast mode, the comparator sends the hinge code modulated to the data driver and prevents the gamma reference voltage generator from changing the gamma reference voltages.

5. The system for driving the LCD panel as claimed in claim 1 wherein when the data driver receives image code around the lowest, in fast mode, the comparator sends die image code un-modulated to the data driver and prevents the gamma reference voltage generator from changing the gamma reference voltages.

6. The system for driving the LCD panel as claimed in claim 1 wherein when the data driver receives image code around the highest, in fast mode, the comparator sends the image code modulated to the data driver and prevents die gamma reference voltage generator from changing the gamma reference voltages.

7. The system for driving the LCD panel as claimed in claim 1 wherein when the data driver receives image code around die highest, in fast mode, the comparator sends the image code un-modulated to the data driver and prevents the gamma reference voltage generator from changing the gamma reference voltages.

8. A system for driving a LCD panel comprising:

a buffer for sending image codes;

a storage for storing the image codes;

a gamma reference voltage generator for generating gamma reference voltages;

a data driver for receiving the image codes and the gamma reference voltages to output driving voltages;

a comparator for comparing the image codes to send to the data driven; and a controller for generating controlling signal to control the storage, the comparator, and the gamma reference voltage generator, wherein the data driver has an arrangement of the image codes and the gamma reference voltages as follows:

the lowest image code corresponding to the lowest gamma reference voltage;

the second lowest image code corresponding to the second lowest gamma reference voltage;

the second highest image code corresponding to tho second highest gamma reference voltage;

the highest image code corresponding to the highest gamma reference voltage; and the other image codes arranged by LCD panel characteristics; and the data driver receives the second lowest image code in the previous frame and the lowest image code in the following frame, in fast mode, the gamma reference voltage generator acts as follows:

when the driving voltage is not equal to a voltage corresponding to the lowest image code, a difference between a voltage of a common electrode in the LCD panel and the lowest gamma reference voltage in fast mode is greater than the difference between the voltage of the common electrode in the LCD panel and the lowest gamma reference voltage; and when the driving voltage is equal to the voltage corresponding to the lowest image code, the difference between the voltage of the common electrode in the LCD panel and the lowest gamma reference voltage in fast mode is equal to the difference between the voltage of the common electrode in the LCD panel and the lowest gamma reference voltage.

9. The system for driving the LCD panel as claimed in claim 8 wherein the LCD panel is normal white.

10. The system for driving the LCD panel as claimed in claim 8 wherein the LCD panel is normal black.

11. The system for driving the LCD panel as claimed in claim 8 wherein when the data driver receives image code around the lowest, in Last mode, the comparator sends the image code modulated to the data driver and prevents the gamma reference voltage generator from changing die gamma reference voltages.

12. The system for driving the LCD panel as claimed in claim 8 wherein when the data driver receives image code around the lowest, in fast mode, the comparator sends the image code un-modulated to the data driver and prevents the gamma reference voltage generator from changing the gamma reference voltages.

13. The system for driving the LCD panel as claimed in claim 8 wherein when the data driver receives image code around the highest, in fast mode, the comparator sends the image code modulated to the data driver and prevents the gamma reference voltage generator from changing the gamma reference voltages.

14. The system for driving the LCD panel as claimed in claim 8 wherein when the data driver receives image code around the highest, in fast mode, the comparator sends the image code un-modulated to the data driver and prevents the gamma reference voltage generator from changing the gamma reference voltages.

* * * * *